US005109416A

United States Patent [19]

Croft

[11] Patent Number: 5,109,416

[45] Date of Patent: Apr. 28, 1992

[54] DIPOLE SPEAKER FOR PRODUCING AMBIENCE SOUND

[76] Inventor: James J. Croft, 7528 10th N.W., Seattle, Wash. 98117

[21] Appl. No.: 590,087

[22] Filed: Sep. 28, 1990

[51] Int. Cl.[5] ..... H04R 5/02

[52] U.S. Cl. ..... 381/24; 381/1

[58] Field of Search ..... 381/24, 89

[56] References Cited

U.S. PATENT DOCUMENTS

| | | | |
|---|---|---|---|
| 3,588,355 | 6/1971 | Holm | 381/24 |
| 4,596,034 | 6/1986 | Moncrieff | 381/24 |
| 4,759,066 | 7/1988 | Polk et al. | 381/24 |
| 4,819,269 | 4/1989 | Klayman | 381/24 |

*Primary Examiner*—Forester W. Isen
*Assistant Examiner*—Sylvia Chen
*Attorney, Agent, or Firm*—Hughes & Multer

[57] ABSTRACT

A dipole speaker for use with a multichannel sound reproduction system for producing an acoustical ambience signal. The dipole speaker comprises a transducer which is connected to the sound reproduction system so that it receives a difference signal from between the channels thereof. The transducer may be a unitary loudspeaker or a pair of identical, outward-facing loudspeakers. In response to a difference signal, the transducer generates first and second sound pressure lobes which extend in opposite directions from the dipole speaker, and which are 180 degrees out of phase so that they cancel one another out to produce a null zone which extends in a plane about the speaker. The dipole speaker is used in conjunction with conventional direct-path speakers which are connected to the sound reproduction system. The dipole speaker is positioned in a defined listening area so that the null zone is aligned towards the listener to avoid any sound travelling along a direct path from the speaker to the listener, and the sound pressure lobes are directed towards the walls of the listening area so that the acoustic signal of the dipole speaker is reflected therefrom and arrives at the listener by way of indirect paths. The acoustic signal of the dipole speaker is thus sensed by the listener as arriving from various directions, and its arrival is delayed relative to the arrival of the acoustic output of the direct-path speakers due to the longer lengths of the indirect paths, both of which enhance the ambience of effect of the acoustic output of the dipole speaker.

22 Claims, 3 Drawing Sheets

DIPOLE SPEAKER FOR PRODUCING AMBIENCE SOUND

BACKGROUND OF THE INVENTION

1. Field of the Invention

The present invention relates to speakers to produce sound in a response to an audio signal, and, in particular, relates to such speakers for the production of an ambience or "surround sound" signal.

2. Background Art

Ideally, sound reproduced through a sound reproduction system, such as that of a stereo high fidelity system, a television, or the like, would sound like the original source. In part, this means that the reproduced sound should have a spatial dimension or quality in that a listener should perceive the sound as being distributed in space as it would be if listening to the original performance. Unfortunately, a problem with conventional sound reproduction systems is the tendency of the sound to be localized by the listener at the loudspeakers, or imaged at a point relative to the loudspeakers.

When a listener hears an original performance, the listener receives some acoustical signals which permit the listener to localize the source of the sound, for example, a particular singer or instrument, and other signals which provide a sense of a spatial dimension, which will be referred to from time-to-time hereinafter as "ambience". The first category of signal is comprised of those which travel along a substantially straight path from the source to the listener; the second set of signals, which are not readily localizable, are those which are reflected off of the walls, ceiling, floor, fixtures, and the like of the listening area. It is these latter singals which provide the sense of ambience or spatiality, and this quality is imparted both by their arrival at the listener from a variety of directions, and by the fact that their arrival is delayed relative to those signals which travel directly from the source to the listener; this delay is the result of the longer paths which the reflected signals must travel. The ambience signals may consequently be delayed on the order of 10 or more milliseconds as compared to the direct path signals.

A number of approaches have been proposed for reproducing the ambience signals with a sound reproduction system. Some of these have employed electronic delay circuitry to delay the signal from the left and right channels of the amplifier of a conventional stereo system, the delayed output then being supplied to dedicated right and left speakers which project the delayed signal along direct paths to the listener. While this approach has achieved some success in producing a "surround sound" effect, it possesses a number of inherent disadvantages: not only is the delay circuitry (which typically requires housing in a separate component) both relatively expensive and noisy, but the approach also ordinarily employs two dedicated "surround sound" speakers, in addition to the conventional, non-delayed speakers of the stereo system.

Another approach is disclosed in U.S Pat. No. 4,596,034, which shows a system in which each channel of a stereo system is reproduced in full by first and second transducers with the output of the first transducer being 180 degrees out of phase with repect to the output of the second transducer. The transducers are positioned such that their acoustic outputs, that is, their sound pressure lobes, are directed to either side of the listener, and a pressure minimum, or null zone, formed between the two lobes is directed towards the listener, eliminating all direct path sound so as to provide a sound field which prevents the listener from localizing the speakers. While this arrangement may help produce an enhanced sense of sound distribution and a decreased awareness that the sound is coming from speakers, this system also possesses several inherent disadvantages. The most significant of these lies in the very fact the the system is intended to prevent the listener from localizing sound for the whole of both channels of the stereo system; in other words, this arrangement renders it difficult or impossible for the listener to localize any of the acoustical signals which are reproduced by the system, regardless of whether those signals were originally recorded as direct path signals or indirect path signals. This is undesirable in that it consequently makes it impossible for the listener to localize those sources (e.g., a singer or particular instrument) where a degree of localization is desirable. The practical result is that the reproduced sound is preceived as being formless or "mushy".

Accordingly, there exists the need for a sound reproduction system which reproduces a non-localizable ambience signal, yet which also reproduces localizable direct-path acoustic signals for those sounds for which such localizability is desirable. Furthermore, there is a need for such a system which does not require noisy and expensive signal delay circuitry, and for such a system which does not require two dedicated speakers to reproduce the ambience acoustical signal.

SUMMARY OF THE INVENTION

The present invention has solved the problems cited above, and comprises generally a dipole speaker for use with a sound reproduction system so as to produce an acoustical ambience signal in a defined listening area, the reproduction system having at least first and second audio signal channels and at least one other speaker which generates an acoustical signal on a substantially direct path to the listener. The dipole speaker comprises at least one transducer for generating an acoustic output in response to an audio signal input, the transducer being configured so that the output signal is characterized by first and second sound pressure lobs which are directed along a first and second axes which extend from the transducer, the first and second sound pressure lobes being 180 degrees out of phase so that they cancel one another out to form a null zone which extends outwardly from the transducer along a third axis. The transducer is connected to the sound reproduction system so that it receives an input signal which is the difference signal between the first and second channels of the system, the transducer generating an acoustic output in response to this difference signal. The transducer is mounted so that the dipole speaker is positionable to place the listener in alignment with the null zone which extends from the transducer along the third axis, and so that the first and second sound pressure lobes which extend outwardly along the first and second axes are reflected from walls of the listening area so as to arrive at the listener by way of indirect paths which are substantially longer than the direct path from the other speaker which is connected to the sound reproduction system, the longer indirect paths causing the arrival of the output from the dipole speaker to be delayed relative to the arrival of the output from the direct path speaker.

The transducer of the dipole speaker may comprise a unitary speaker having a diaphragm which is deflected in first and second directions perpendicular to a transverse plane of said diaphragm in response to the signal input, the first and second directions being substantially opposite to one another, and the third axis (along which the null zone extends from the speaker) being substantially coplanar with the transverse plane of the diaphragm. The unitary speaker may be mounted in a planar baffle which is substantially coplanar with the transverse plane of the diaphragm, the dipole speaker being positionable in the listening area with the baffle aligned so that the listener's position is within the plane of the baffle.

The transducer may also comprise first and second speakers which are configured to generate the first and second sound pressure lobes in response to the audio signal input. The first and second speakers are connected to the sound reproduction system so that the first and second sound pressure lobes generated are 180 degrees out of phase. The first and second speakers may be mounted in a unitary, planar baffle so that the first and second sound pressure lobes are radiated outwardly along the first and second axes perpendicularly from the baffle, or the first and second speakers may be mounted in first and second substantially planar baffles which are mounted parallel to one another in a speaker cabinet. The speaker cabinet may be substantially enclosed so as to form a confined air space intermediate the inner surfaces of the first and second baffles, so that as the first and second speakers generate the first and second sound lobes which are 180 degrees out of phase, the diaphragm of one speaker moves inwardly toward the speaker box so as to force a volume of air into the combined air space and the diaphragm of the other speaker moves outwardly from the speaker box so as to withdraw a volume of air from the speaker box which is substantially equal to that which has been forced into the box, so that the inward and outward movement of the diaphragm of each speaker is assisted by the complementary inward and outward movement of the diaphragm of the other speaker.

A transducer of the dipole speaker may have first and second leads such that the transducer generates an acoustic output in response to an audio signal input applied across the leads, the first lead being connected to a selected output of the first channel of the stereo reproduction system, each channel of the system including an output having a positive polarity and an output having a negative polarity, and the negative lead of the transducer being connected to a selected output of the second channel of the system, the selected output of the second channel having the same polarity as the selected output of the first channel, so that the signal input applied across the leads of the transducer is a difference signal between output of the two channels.

DETAILED DESCRIPTION

Figure 1:
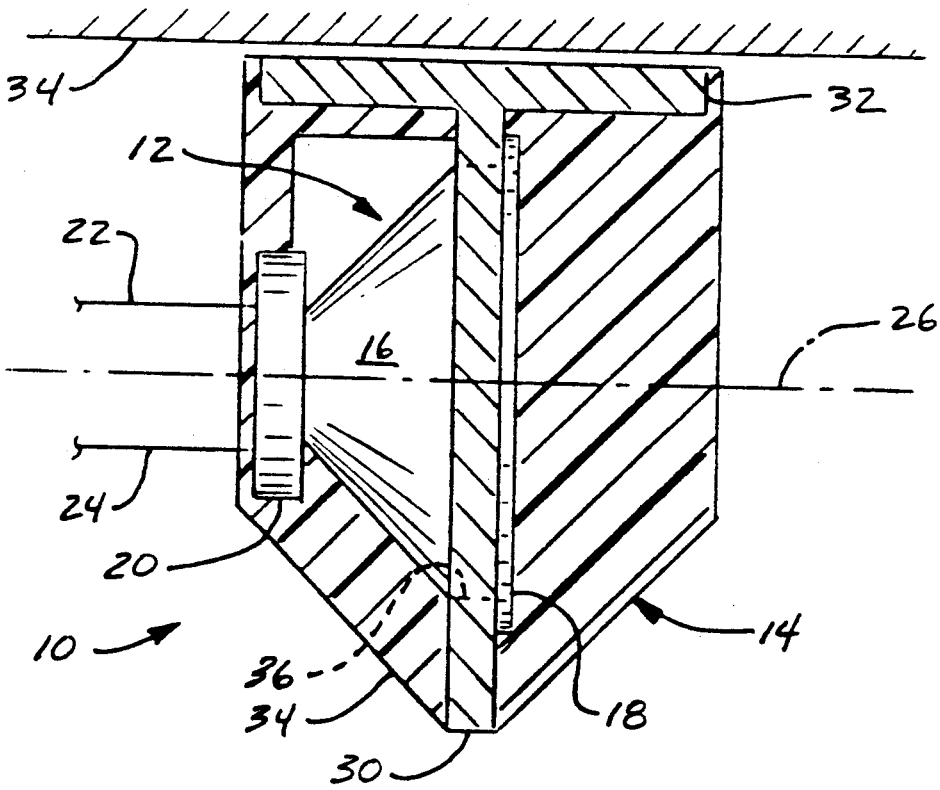
FIG. 1 is an overhead view of a section taken through a dipole speaker embodying the present invention, this embodiment being provided with a single transducer which produces a null zone which is aligned towards the listener.

FIG. 1 shows an overhead view of a dipole speaker 10 which comprises generally a loudspeaker assembly 12 and a cabinet assembly 14. Loudspeaker assembly 12 is preferably a conventional full range transducer having a frequency range, for example, of 100 Hz through 7 KHz. Loudspeaker assembly 12 has a diaphragm portion 16, which, in this example, is a substantially conical diaphragm having a mounting ring 18 at its wide, projection or mouth end, and a driver portion 20 at its narrow end. Driver portion 20 is provided in a conventional manner with a positive and negative connections or leads 22 and 24, so that loudspeaker 12 generates an acoustic signal in response to an audio signal input applied across leads 22 and 24. As will be discussed below, these acoustic signals are projected in first and second sound pressure lobes which extend in opposite direction from loudspeaker assembly 12, and which are 180 degrees out of phase so as to form a null zone which, in the example of FIG. 1, extends in a transverse plane which is substantially perpendicular to the longitudinal axis 26 of diaphragm portion 16.

Cabinet assembly 14, in turn, comprises generally a baffle plate 30, a support bracket 32, and an acoustically transparent enclosure 34, the latter being constructed of any suitable material such as speaker cloth, acoustic foam or the like. Baffle plate 30, which is preferably constructed of particle board or the like, is provided with a circular opening or bore 36 through which conical diaphragm 16 passes, mounting ring 18 being mounted to a first side of baffle plate 30 so that the conical diaphragm portion 16 extends through bore 36 outwardly from the other side of baffle plate 30. Accordingly, the sound pressure lobes generated by diaphragm portion 16 extend outwardly to the right and left from baffle plate 30, along axis 26 shown in FIG. 1, and baffle plate 30 is mounted to diaphragm portion 16 so that it extends in a transverse plane thereof. Accordingly, baffle plate 30 lies in the plane of the null zone formed between the first and second sound pressure lobes. The edge of baffle plate 30 is mounted at right angles to support bracket 32, the resulting T-shaped arrangement facilitating convenient placement of dipole speaker 10 against a wall 34 so that baffle plate 30, and the null zone produced by loudspeaker assembly 12, project therefrom towards the location of the listener.

Figure 2:
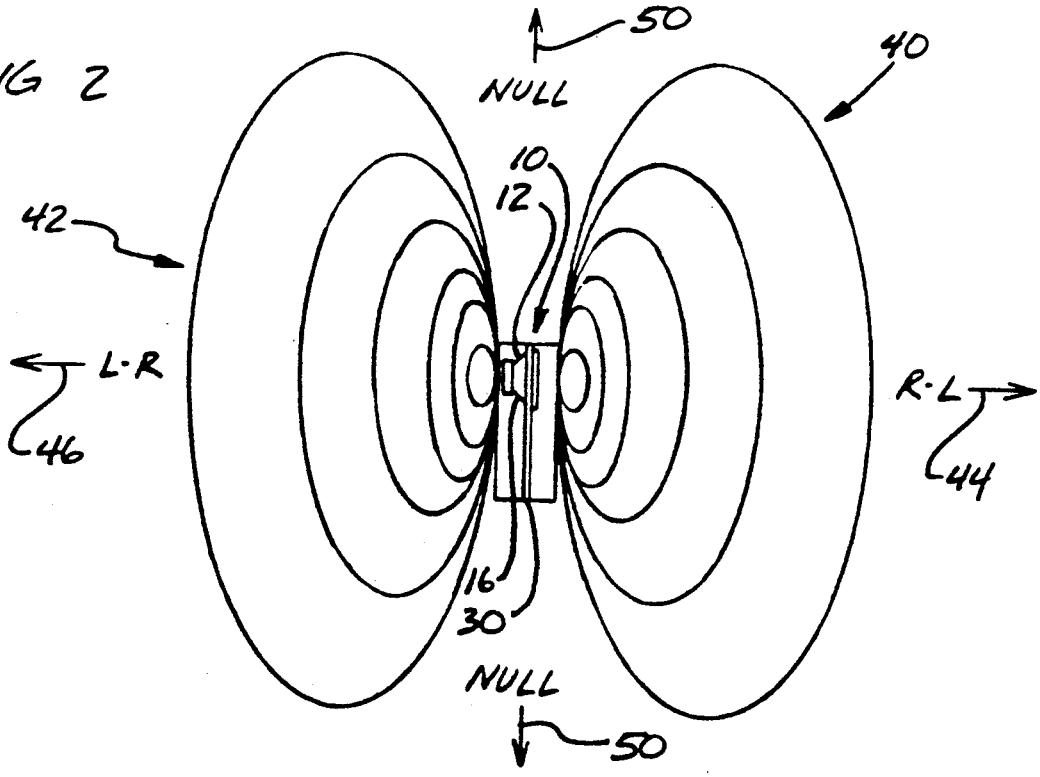
FIG. 2 is an overhead schematic view of the dipole speaker of FIG 1, showing the first and second sound pressure lobes and null zones which are produced by the speaker in response to an audio input signal.
Figure 6:
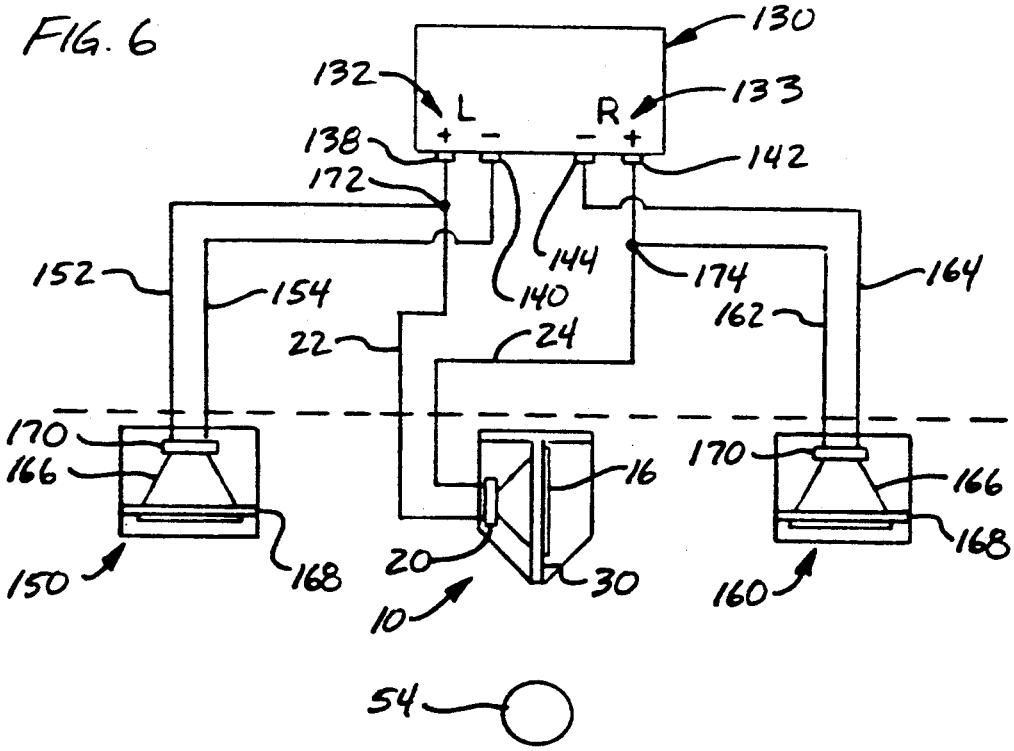
FIG. 6 shows one exemplary arrangement for connecting the dipole speaker 10 to a stereo amplifier 130 so that the speaker 10 receives a difference signal.

FIG. 2 shows the distribution pattern of sound pressure lobes and null zones formed by the operation of dipole speaker 10. As will be described in greater detail below, dipole speaker 10 is connected to a stereo amplifier, or other suitable stereo audio signal source, so that it receives a difference signal from between the left and right channels of the source. As is shown in FIG. 6, this may be accomplished by connecting leads 22 and 24 across the positive outputs of both left and right channels. In the difference signal, the "mono" signals which are generated on the two channels (i.e. signals which are substantially the same on both the left and right channels) are cancelled out, and thus these do not produce any acoustic signal at the dipole speaker. If, however, there is a difference between the signals in the two channels, the resulting difference signal at the dipole speaker causes it to generate an acoustic output. In ordinary stereo reproduction, the signals of the right and left hand channels may be considered as containing both "mono" signals and "difference" signals. The advantage of using only the difference signals to power the dipole speaker 10 is that it is the difference signals which tend to provide the listener with a perceived ambience sound. Essentially, this is because the stereo microphones are normally focused on the point sources (e.g., a singer) when stereo recording is made, these point sources being reproduced more or less as monotype signals (which are cancelled out at the dipole speaker 10). However, those sounds in the original performance which are not centrally located, and hence not focused on by the stereo microphones (e.g., those sounds which approach the microphones from off to the right or left of the central singer or instrument), tend to be recorded differently by the two microphones; when these are reproduced, the difference between the right and left channels produces the difference signal which drives the dipole speaker 10. Since these sounds represent those which are not the central focus of the stereo recording, but rather those which approach the recording area from the surrounding area (i.e., those sounds which have been reflected back from walls, ceilings, and the like), these are the sounds that are perceived by the listener during the original performance as ambience sounds (as opposed to direct path sounds), and, when reproduced by means of the dipole speaker of the present invention, they are again perceived by the listener as ambience sounds.

It should be noted at this point that although, for illustrative purposes, this description focuses on the use of a dipole speaker in conjunction with a stereo sound reproduction system which has two channels, the present invention may be applied to any sound reproduction system which has a plurality of channels, including those systems having more than two channels.

FIG. 2 shows the first and second sound pressure lobes 40 and 42 which are produced by dipole speaker 10 in response to the difference signal between the first and second channels of the stereo reproduction system, and which are projected outwardly in the opposite directions indicated by arrows 44 and 46. Inasmuch as the dipole speaker is being driven with the difference signal, by definition the first side of loudspeaker assembly 12 emits a left-minus-right signal (in this case represented by sound pressure lobe 42), while the other side emits a right-minus left signal (as represented by sound pressure lobe 40). Since these lobes 40 and 42 are 180 degrees out of phase, they cancel one another out where they meet to produce a null zone which is substantially co-planar with the plane of baffle plate 30, and which extends outwardly from dipole speaker 10 generally in the directions indicated by arrows 50.

It will be understood that the single dipole speaker 10 thus produces, in separate sound pressure lobes, both a left-minus-right and a right-minus-left signal. This maintains the separation of the rear channel, and permits the single dipole speaker 10 to, in essence, simulate two separate loudspeakers, as are used in conventional "surround-sound" systems to individually generate the left-minus-right and right-minus-left signals.

Figure 3:
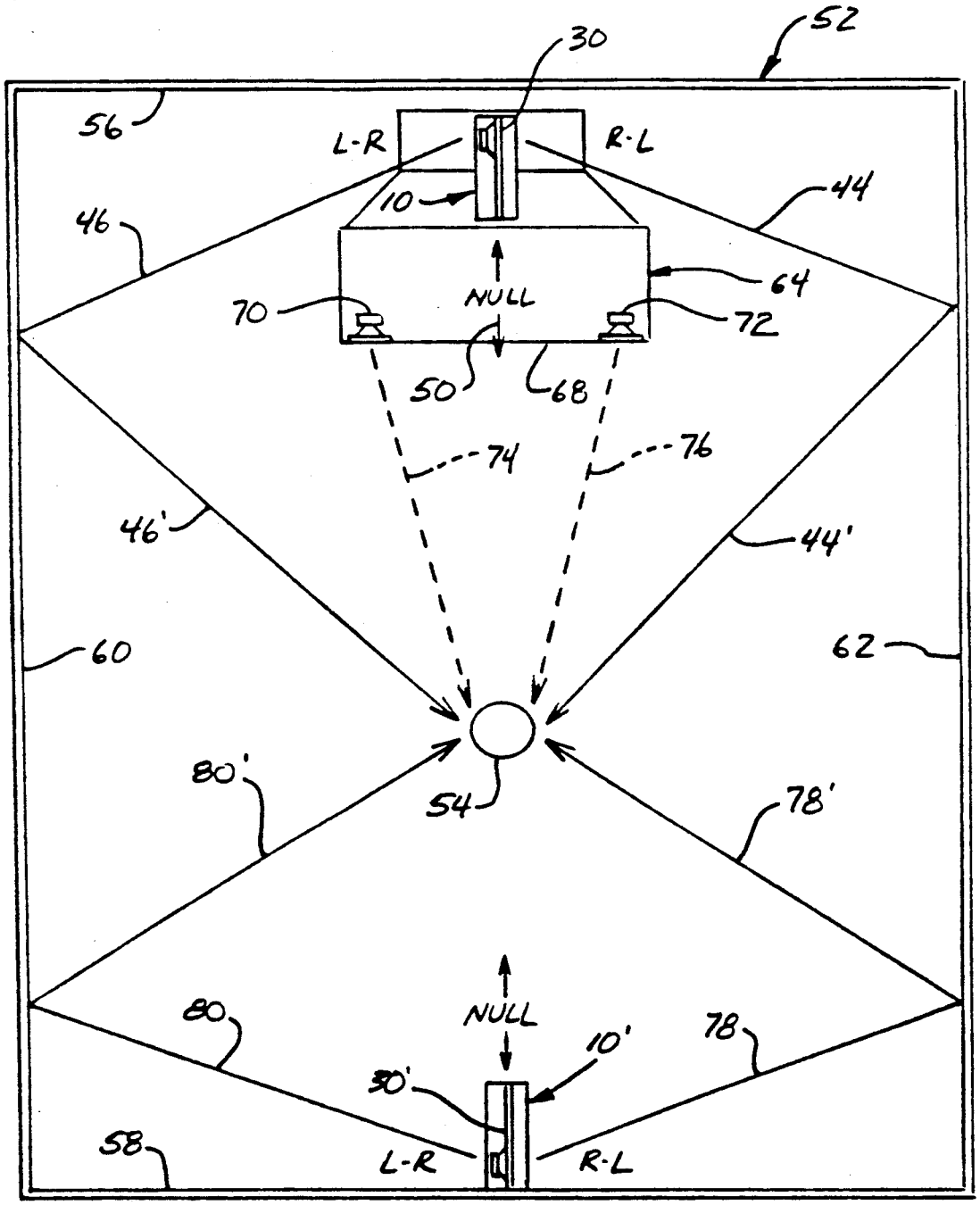
FIG. 3 is an overhead schematic view of the dipole speaker of FIGS. 1-2, with the speaker being connected to an illustrative sound reproduction system (a television) and positioned in a defined listneing area so that the acoustic signals are directed against the walls of the listening area and reflected to listener, the dipole speaker being shown in a first position in front of the listener, and in a second, alternative position behind the listener.

FIG. 3 shows dipole speaker 10 placed in a defined listening area provided by room 52, with the projection paths of the sound pressure lobes and null zone oriented so that the sound reproduced by the dipole speaker is perceived by listener 54 as ambience sound. Two approaches are shown for arranging dipole speaker 10 relative to the listener 54, in the first case the dipole speaker being positioned in front of the listener, and in the second case the dipole speaker being positioned behind the listener. In both cases, the listener 54 is positioned within room 52, which has front and rear walls 56 and 58, and left and right side walls 60 and 62.

In the first arrangement, the dipole speaker 10 is positioned in front of listener 54 and adjacent to front wall 56; in the example illustrated, dipole speaker 10 is positioned in back of a conventional stereo-equipped television set 64 which is viewed by listener 54, and which is provided with stereo sound reproduction system having left and right channels. As was discussed above, dipole speaker 10 is connected to the stereo reproduction system so as to receive a difference signal from between the two channels. Dipole speaker 10 is oriented so that the plane of its baffle plate 30 is generally aligned with the position of listener 54, this being conveniently accomplished here by mounting dipole speaker 10 to the back of the television cabinet 66 so that the plane of baffle plate 30 is perpendicular to that of the viewing screen 68. The null zone consequently extends from dipole speaker 10 in the direction indicated by arrows 50 so as to include the listener's position, thereby preventing any sound from reaching listener 54 along a direct path from dipole speaker 10 and avoiding undesirable localization of the sound produced by the dipole speaker. The R-L and L-R sound lobes are, in turn, projected outwardly from dipole speaker 10 along the paths indicated by arrows 44 and 46 against side walls 62 and 60, from which the sound pressure lobes are reflected and reach the listener more or less along the indirect paths indicated by arrows 44' and 46'. Thus, since the direct path sound has been cancelled out, the first audible signal arriving at the listener's ears from speaker 10 is the wall reflection, and therefore the sound sources are sensed as coming from the sides (or possibly the rear) of room 52. Since the distance traveled by these reflected sounds (along paths indicated by arrows 44—44' and 46—46') are considerably longer than the distance which the sound would have traveled by way of a direct path to the listener, their arrival at the listener is delayed relative to the time at which a corresponding direct path signal would arrive. In this case, the arrival of the ambience sound signals is delayed relative to the direct-path acoustic signals which are generated by the conventional left and right frontally-directed speakers 70 and 72 of television set 64, which travel to the listener 54 along the direct paths indicated by arrows 74 and 76. Hence, not only is the ambient sound projected by dipole speaker 10 non-localizable, but its arrival at the listener is delayed relative to that of the direct path signals, both of which enhance the ambience sound or "surround sound" effect. Furthermore, it will be observed that the delay of the ambience signal is achieved with out the need for expensive and noisy delay circuitry.

The system of the present invention avoids the problems of unclear, "mushy"-sounding signals (as were previously discussed with reference to the system of the Moncrieff patent) by projecting those signals which are desirably localizable along the direct paths 74 and 76 from forward facing stereo speakers 70 and 72, on which are reproduced the whole of the left and right channels of the stereo system, thus permitting the listener to image the location of the signals which are the focus of the recording.

Since the ambience signal generated by dipole speaker 10 is intended to be non-localizable, it is not necessary that speaker 10 be positioned in front of the listener, and it can thus be positioned elsewhere in the room so long as the proper orientation with respect to the listener is maintained. In the second arrangement shown in FIG. 3, the dipole speaker 10' is positioned behind the listener 54 (who remains oriented so as to watch television 64 and listen to its direct path stereo speakers 70 and 72), against the rear wall 58 of room 52. Speaker 10' remains oriented, however, with its planar baffle plate 30' aligned toward listener 54 so that the null zone extends in the direction indicated by arrow 50' to include the listener's location. The sound lobes are consequently projected in the directions indicated by arrows 78 and 80 against side walls 62 and 60, from which they are reflected along the indirect paths indicated by arrows 78' and 80' to listener 54. If desired, a plurality of dipole speakers 10 can be so utilized, preferably arranged in a symmetrical array about the listener, with each having its baffle plate and null zone aligned toward the listener and so that its sound pressure lobes are reflected off of the walls of the room.

In the above described arrangements, the desired delay of the ambience signals relative to the direct path signals is produced by means of the extended path of travel which results from reflecting the sound lobes off of the walls of the room to the listener; this technique has proven eminently suitable for use in rooms having dimensions of roughly 12 feet by 20 feet or greater, this providing sufficient distance to the walls in order to achieve the desired delay of some ten to twenty milliseconds. For use in smaller rooms, or for enhanced ambience effects (e.g. to simulate a larger environment, such as that of a concert hall), it may be desirable to include some delay circuitry to delay the input signal going to the dipole speaker relative to that going to the direct path speakers so as to ensure the desired time delay, although by use of the reflected paths, the dipole speaker of the present invention enables the amount of such delay circuitry to be kept to a minimum. In such an arrangement, the left-minus-right input described above could, as is current practice in Dolby TM "surround-sound" processors, be routed through a delay circuit and then through a Dolby TM noise reduction circuit and a low pass filter (which, for reasons discussed below, reduces the high frequency output), and then the subsequent output could be supplied via an amplifier to the single dipole speaker of the present invention rather than the dual-speaker arrangement of the currect-practice systems. The present invention may similarly be applied to a wide variety of other difference signal-derived ambience or "surround-sound" multichannel processors, including, for example, the THX TM systems processors which are known to those skilled in the art.

Figure 4:
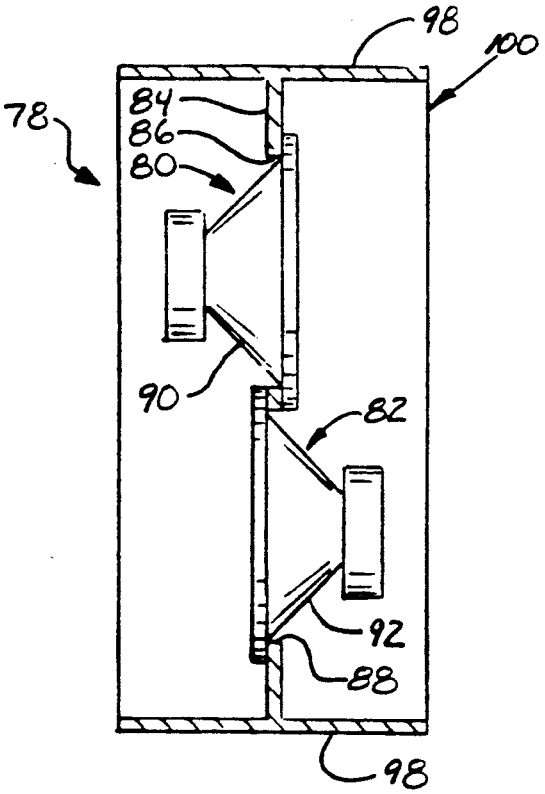
FIG. 4 is an overhead view of a section through another dipole speaker embodying the present invention, this embodiment having first and second transducers mounted in a single baffle so as to project sound lobes in opposite directions therefrom.

While the dipole speaker 10 having a single internal loudspeaker assembly 12 is a notably inexpensive and effective arrangement, it will be noted that, due to the construction of the single loudspeaker assembly, the signal projected from its first side will almost inevitably be slightly different than that projected from its other side. Because the two signals may thus differ slightly, a less than perfect null zone may be formed between the two. Although a suitable loudspeaker assembly might be provided to generate a more symmetrical wave form on both sides, this would likely have to be more or less unique to this application, instead of being an inexpensive "off-the-shelf" loudspeaker. Accordingly, it may prove advantageous in terms of economy and sound quality to provide a pair of identical speakers in place of the single speaker described above, with the pair of speakers being connected to the signal source so as to be 180 degrees out of phase. FIG. 4 shows such an arrangement, in which identical first and second loudspeaker assemblies 80 and 82 are mounted in a single planar baffle plate 84. Baffle plate 84 is provided with first and second circular openings 86 and 88 in which the mouth ends of loudspeaker assemblies 80 and 82 are mounted so as to project their respective acoustic signals in opposite directions, each loudspeaker assembly 80, 82 having a conical diaphragm 90, 92 which extends back through the opening 86, 88 to a driver portion 94, 96. Baffle plate 84 is, in turn, mounted at each end to a support bracket 98, which forms an integral part of a speaker cabinet 100. Since the identical loudspeaker assemblies 80 and 82 produce identical acoustic signals which are 180 degrees out-of-phase, a near-perfect null zone is formed along the plane of baffle plate 84.

Figure 5:
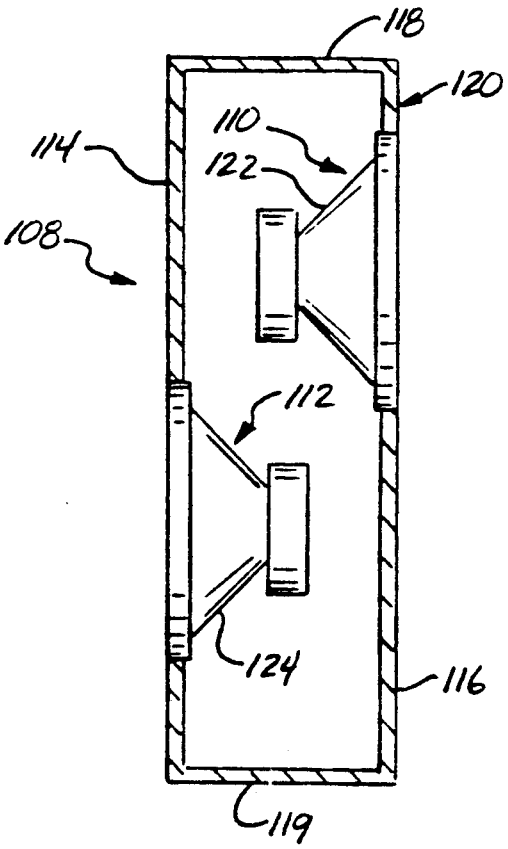
FIG. 5 is an overhead view of a section through another dipole speaker embodying the present invention, this embodiment having two transducers mounted in parallel baffles in a speaker enclosure.

FIG. 5 shows another dual-transducer arrangement, and in this case the identical first and second loudspeaker assemblies 110 and 112 are mounted in separate, parallel planar baffle plates 114 and 116. The two baffle plates are connected by end walls 118 and 119, which, together with top and bottom walls (not shown), may preferably form an enclosed air space within speaker cabinet enclosure or assembly 120. This arrangement is particularly advantageous in that not only is a near-perfect null zone formed in the plane between the loudspeakers, but also the 180 degree out-of-phase movement of the diaphragms 122, 124 of loudspeaker assemblies 110 and 112 (which are connected to the difference signal 180 degrees out of phase with each other) move in a complimentary fashion so as to eliminate any air spring in the enclosed speaker cabinet assembly 120, each movement of a loudspeaker assembly being assisted by the complementary movement of the other loudspeaker assembly. In other words, as the diaphragm of the first loudspeaker moves inwardly toward the enclosed speaker cabinet or box so as to force a volume of air into the confined air space, the diaphragm of the other loudspeaker assembly moves outwardly from the cabinet so as to withdraw an equal volume of air, the inward and outward movement of each loudspeaker assembly thus assisting the inward and outward movement of the other loudspeaker assembly. This arrangement consequently allows for the use of high efficiency speakers having lightweight cones and relative low mass magnets in their driver portions.

Each of the loudspeaker assemblies used in the dual-transducer dipole speakers 78 and 108 may preferably be a conventional five inch speaker having a range of response from about 100 Hz to 7 KHz. For the single loudspeaker assembly version shown in FIG. 1, a single 8 inch speaker having a similar frequency range has been found suitable. As was noted above, a low pass filter may be used to eliminate high frequencies, preferably be in the 2,000 Hz and above range, good results having been achieved with the system of the present invention using a range of 300 Hz to 2,000 Hz. Use of the lower frequency range is particularly advantageous with the single-transducer arrangement of FIG. 1, inasmuch as this renders it significantly easier to attain near-symmetrical wave forms on either side of the speaker diaphragm. Furthermore, the lower frequency range signals taken from the difference signal are most suitable for realistically reproducing the ambience sound, inasmuch as in the original performance the higher frequency sounds are typically absorbed by walls, furniture, wall hangings and the like, and the remaining reflected sounds (which are perceived as ambience) are consequently more in the lower frequency range. As an additional refinement, it is desirable that the dipole speaker generate sound at a level which is somewhat louder (e.g., 3 dB louder) than that produced by the two, conventional front facing speakers. Thus, after the sound produced by the dipole speaker is reflected off the walls of the listening area, it will be reduced in intensity and perceived by the listener as being softer, and thus more like true ambience sound.

FIG. 6 shows one exemplary arrangement for connecting the dipole speaker 10 to a stereo sound reproduction amplifier 130 so that the dipole speaker receives a difference signal. Stereo amplifier 130, in conventional manner, is provided with left and right channels, indicated generally by reference numerals 132 and 133. The output for left channel 132 is provided by a positive output jack 138 and a negative output jack 140; similarly, the output for the right channel is provided by a positive output jack 142 and a negative output jack 144. In conventional fashion, the left, front facing, direct path stereo speaker 150 has a first lead 152 which is connected to the positive output jack 138 of left channel 132, and a second lead 154 which is connected to the negative output jack 140. Similarly, right forward facing speaker 160 has a first lead 162 which is connected to the positive output jack 142 of the right channel 133, and a second lead 164 which is connected to the negative output jack 144. Left and right speakers 150 and 160 each have conventional, forward facing diaphragm portions 166 which are mounted in baffle plates 168, and which are driven by driver portions 170 so as to produce conventional stereo acoustical signals which travel on the direct paths 74 and 76 shown in FIG. 3 to the listener 54.

Dipole speaker 10, as was described above, is provided with first and second leads 22 and 24. Lead 22 is connected to the positive output jack 138 of left channel 132, and the other lead 24 is connected to the positive output jack 142 of the right channel 133. As was described above, this inexpensive and effective arrangement provides dipole speaker 10 with an audio input signal which represents the difference between the signals of the left and right channels outputted by amplifier 130.

It is to be understood that various modifications could be made to the illustrative embodiments shown herein without departing from the spirit and scope of the present invention. Accordingly, the invention is not to be limited except as by the appended claims.

What is claimed and desired to be secured by Letters Patent of the United States is:

1. A dipole speaker for use with a sound reproduction system to produce an acoustical ambience signal which is perceived by a listener in a defined listening area, said sound reproduction system having a plurality of audio signal channels and at least one direct-path speaker for generating an acoustical signal along a substantially direct path to said listener in response to an audio signal received by said direct-path speaker from a said channel of said system, said dipole speaker comprising:

at least one transducer means for generating an acoustic output signal in response to an audio signal input, said transducer means being configured so said acoustic output signal is characterized by a first sound pressure lobe which is projected substantially along a first axis from said transducer means and a second sound pressure lobe which is projected substantially along a second axis from said transducer means, said first and second sound pressure lobes being substantially 180 degrees out-of-phase and meeting along a plane intermediate said first and second axes so that said first and second sound pressure lobes cancel each other out to form a null zone which extends outwardly from said transducer means substantially along said plane;

means for connecting said transducer means to said sound reproduction system so that said transducer means receives an audio signal input from said sound reproduction system which is a difference signal produced by the difference between an audio signal of said first channel and an audio signal of said second channel, so that said transducer means generates said acoustic output in response to said difference signal; and support means mounted to said transducer means and positionable in said defined listening area with said listener substantially in alignment with said null zone which extends along said plane from said transducer means, and with said first and second axes aligned so that said first and second sound pressure lobes extend outwardly from said transducer means and are reflected from walls of said defined listening area so as to arrive at said listener by way of indirect paths, substantially no output from said transducer reaching the listener by a direct path, said indirect paths being longer than said substantially direct path from said direct-path speaker to said listener, so that the arrival of said acoustic output from said dipole speaker at said listener is delayed relative to the arrival at said listener of said acoustic output signal from said direct-path speaker.

2. The dipole speaker of claim 1, wherein said at least one transducer means comprises:

a unitary loudspeaker, said unitary loudspeaker having a diaphragm which is deflected in the directions of said first and second axes in response to said audio signal input, said directions of said first and second axes being substantially opposite to one another, and said plane along which said null zone extends being substantially coplanar with a transverse plane of said diaphragm of said unitary loudspeaker.

3. The dipole speaker of claim 2, wherein said support means comprises:

a planar baffle mounted to said unitary loudspeaker so that said baffle is substantially coplanar with said transverse plane of said diaphragm of said unitary loudspeaker; and a housing mounted to said baffle, said housing being configured so that said unitary loudspeaker is positionable in said defined listening area with the plane of said baffle aligned with the position of said listener, and with said first and second axes aligned so that said first and second sound pressure lobes extend perpendicularly from said plane of said baffle in opposite directions and are reflected from walls of said defined listening area so as to arrive at said listener by way of said indirect paths.

4. The dipole speaker of claim 3, wherein each channel of said sound reproduction system has an output having positive polarity and an output having negative polarity, and said unitary loudspeaker has a first lead and a second lead such that said unitary loudspeaker generates said acoustic output signal in response to an audio signal input applied across said first and second leads, and said means for connecting said transducer means to said sound reproduction system so that said transducer means receives said difference signal comprises:

a first electrical connector for connecting said first lead of said unitary loudspeaker to a selected output of a first channel of said sound reproduction system; and a second electrical connector for connecting said second lead of said unitary loudspeaker to a selected output of a second channel of said sound reproduction system, said selected output of said second channel having the same polarity as said selected output of said first channel.

5. The dipole speaker of claim 1, wherein said at least one transducer means comprises:

a first loudspeaker, said first loudspeaker being configured to generate said first sound pressure lobe in response to said audio signal input;

a second loudspeaker, said second loudspeaker being configured to generate said second sound pressure lobe in response to said audio signal input;

means for connecting said first and second loudspeakers to said sound reproduction system so that said first and second sound pressure lobes are substantially 180 degrees out of phase; and mounting means for mounting said first and second loudspeakers so that said first and second sound lobes are directed outwardly from said mounting means substantially along said first and second axes.

6. The dipole speaker of claim 5, wherein said first and second axes extend from said mounting means in substantially opposite directions.

7. The dipole speaker of claim 6, wherein said first and second loudspeakers each have a diaphragm portion which radiates a said sound pressure lobe along a said axis from a mouth end of said diaphragm portion, and a driver portion which extends rearwardly from said mouth end of said diaphragm portion.

8. The dipole speaker of claim 7, wherein said mounting means for mounting said first and second loudspeakers comprises a unitary, substantially planar baffle having first and second openings therethrough for accommodating said first and second loudspeakers, said mouth end of said first speaker being mounted in said first opening so that said baffle is substantially coplanar with a tranverse plane of said diaphragm portion of said first loudspeaker and said diaphragm portion of said first loudspeaker radiates said first sound pressure lobe outwardly along said first axis perpendicular to a first surface of said planar baffle, and said driver portion of said first loudspeaker projects outwardly from a second surface of said planar baffle, and said mouth end of said second loudspeaker being mounted in said second opening so that said baffle is substantially coplanar with a transverse plane of said diaphragm portion of said second loudspeaker and said diaphragm portion of said second loudspeaker radiates said second sound pressure lobe outwardly along said second axis perpendicular to said second surface of said baffle, and said driver portion of said second loudspeaker projects outwardly from said first surface of said planar baffle.

9. The dipole speaker of claim 7, wherein said means for mounting said first and second loudspeakers comprises first and second substantially planar baffles, said first and second baffles being mounted in a speaker cabinet so as to be substantially parallel to one another, each said baffle having an opening therethrough for accommodating a said loudspeaker, said mouth end of said diaphragm portion of said first loudspeaker being mounted in said opening in said first baffle so that said diaphragm portion of said first loudspeaker radiates said first sound pressure lobe outwardly from an outer surface of said first baffle, said driver portion of said first loudspeaker projecting outwardly from an inner surface of said first baffle, and said mouth end of said diaphragm portion of said second loudspeaker being mounted in said opening in said second baffle so that said diaphragm portion of said second loudspeaker radiates said second sound pressure lobe outwardly from an outer surface of said second baffle, said driver portion of said second loudspeaker projecting outwardly from an inner surface of said second baffle.

10. The dipole speaker of claim 9, wherein said speaker cabinet is substantially enclosed so as to form a confined air space intermediate said inner surfaces of said first and second baffles, so that when, as said first and second loudspeakers generate said first and second sound pressure lobes which are 180 degrees out-of-phase, said diaphragm portion of a said loudspeaker moves inwardly toward said substantially enclosed speaker cabinet so as to force a volume of air into said confined air space, said diaphragm portion of the other loudspeaker moves outwardly from said speaker cabinet so as to withdraw a volume of air from said speaker cabinet which is substantially equal to said volume of air which is forced into said speaker cabinet, whereby said inward and outward movement of said diaphragm portion of each said first and second loudspeaker assists said inward and outward movement of said diaphragm portion of said other loudspeaker by preventing the formation of any air spring in said confined air space in said substantially enclosed speaker cabinet.

11. A dipole speaker for use with a sound reproduction system to produce an acoustical ambience effect which is perceived by a listener in a defined listening area, said sound reproduction system having first and second spaced-apart, direct-path speakers for generating first and second acoustical outputs along direct paths to said listener in response to audio signals received by said first and second direct-path speakers from respective first and second audio signal channels of said system, said dipole speaker comprising:

at least one transducer for generating an acoustic output in response to an audio difference signal received from said system, said difference signal being the difference between said audio signals of said first and second channels of said sound reproduction system, said acoustic output being characterized by first and second sound pressure lobes which extend from said transducer substantially along respective first and second axes, said first and second sound pressure lobes being 180 degrees out-of-phase and meeting so that said sound pressure lobes cancel each other out to form a null zone which extends from said transducer substantally along a plane intermediate said first and second axes; and structural means for supporting said transducer in a position at a spaced distance apart from each of said direct-path speakers so that said acoustic outputs of said dipole speaker and said direct-path speakers remain substantially unblended and distinct, with said transducer being positioned so that said listener is located so that substantially no acoustic output of said dipole speaker reaches said listener by a direct path, and so that said first and second sound pressure lobes are directed along said first and second axes against walls of said defined listening area and are reflected from said walls so as to arrive at said listener by way of indirect paths, at least one said indirect path being longer than either of said direct paths from said direct path speakers to said listener, so that said listener hears said distinct acoustic output of said dipole speaker arriving after a perceptible delay following the arrival of the corresponding distinct acoustic output of said direct path speakers at said listener, said perceptible delay sufficient in length that said listener perceives said output of said dipole speaker as producing said acoustic ambience effect.

12. the dipole speaker of claim 11, wherein said sound reproduction system is a stereo sound system having said first second audio signal channels, and said first and second direct-path speakers are first and second free-standing stereo loudspeakers, and wherein said structural means for supporting said transducer of said dipole speaker is configurated to permit said transducer to be positioned at various locations in said defined listening area independently of said stereo loudspeakers.

13. The dipole speaker of claim 11, wherein said first and second direct path speakers are integrally mounted in a housing with sound reproduction system, and said structural means for supporting said transducer of said dipole speaker is mounted to said housing so that (a) said dipole speaker is also integrally mounted to said housing; and (b) said dipole speaker is spaced apart from said first and second direct path speakers so that said acoustic outputs of said direct-path speakers and said dipole speaker remain substantially unblended and distinct.

14. The dipole speaker of claim 13, wherein said first and second direct-path speakers are front-facing speakers mounted in forward portions of said housing for facing towards said listener, said transducer of said dipole speaker is mounted to a reaward portion of said housing behind said front facing direct-path speakers so that said axes of said first and second sound pressure lobes extending from said transducer do not cross said direct paths from said front-facing speakers to said listener.

15. The dipole speaker of claim 14, wherein said sound reproduction system is a stero television set.

16. A dipole speaker for use with a sound reproduction system to produce an acoustical ambience effect which is perceived by a listener in a defined listening area, said sound reproduction system having first and second spaced-apart, direct-path speakers for generating first and second acoustical outputs along direct paths to said listener in response to audio signals received by said first and second direct-path speakers from respective first and second audio signal channels of said system, said dipole speaker comprising:

at least one transducer for generating an acoustic output in response to an audio difference signal received from said system, said difference signal being the difference between said audio signals of said first and second channels of said sound reproduction system, said acoustic output being characterized by first and second sound pressure lobes which extends from said transducer substantially along respective first and second axes, said first and second sound pressure lobes being 180 degrees out-of-phase and meeting so that said sound pressure lobes cancel each other out to form a null zone which extends from said transducer substantially along a plane intermediate said first and second axes; and structural means for supporting said transducer, said structural means being configured to permit said transducer to be located in said listening area in a location which is spaced apart from said direct path speakers and be oriented so as to prevent said axes of said first and second sound pressure lobes which extend from said transducer from crossing said direct paths from said direct path speakers to said listener, so that said acoustic outputs of said dipole speaker and said direct-path speakers remain substantially unblended and distinct, with said transducer being aligned so that said listener is positioned substantially within said plane of said null zone so as to prevent substantially any acoustic output of said dipole speaker from reaching said listener by a direct path, and so that said first and second sound pressure lobes are directed along said first and second axes against walls of said defined listening area and are reflected from said walls so as to arrive at said listener by way of indirect paths, at least one said inderect path being longer than either of said direct paths from said direct path speakers to said listener so that said listener hears said distinct acoustic output of said dipole speaker arriving after a perceptible delay following the arrival of the corresponding distinct acoustic output of said direct path speakers, said perceptible delay being sufficient in length that said listener perceives said output of said dipole speaker as producing said acoustic ambience effect.

17. A sound reproduction system for producing an acoustical ambience effect which is perceived by a listener in a defined listening area, said sound reproduction system comprising:

an audio signal source having first and second audio signal channels;

first and second direct-path speakers, each said direct path speaker being configured to generate an acoustic output along a substantially direct path to said listener in response to an audio signal input received from a respective said channel of said audio signal source; and a dipole speaker having a transducer for generating an acoustic output in response to an audio signal input, said transducer being connected to said audio signal source so that audio signal input to said dipole speaker is the difference between said audio signals of said first and second channels of said signal source, said acoustic output of said transducer being characterized by first and second sound pressure lobes which extend from said transducer substantially along respective first and second axes, said first and second sound pressure lobes being 180 degrees out-of-phase and meeting so that said first and second sound pressure lobes cancel each other out to form a null zone which extends from said transducer substantially along a plane intermediate said first and second axes; and structural means for mounting said transducer in a position which is spaced apart from each of said direct-path speakers so that said acoustic outputs of said dipole speaker and said direct-path speakers remain substantially unblended and distinct, with said transducer being positioned so that said listener is located so that substantially no acoustic output of said dipole speaker reaches said listener by a direct path, and so that said first and second sound pressure lobes are directed along said first and second axes against walls of said defined listening area and are reflected from said walls so as to arrive at said listener by way of indirect paths, at least one said indirect path being longer than either of said direct paths from said direct path speaker to said listener so that said listener hears said distinct acoustic output of said dipole speaker arriving after a perceptible delay following the arrival of the corresponding distinct acoustic output of said direct path speakers, said perceptible delay being sufficient in length that said listener perceives said output of said dipole speaker as producing said acoustic ambience effect.

18. The sound reproduction system of claim 17, wherein said audio signal source is a stereophonic amplifier, and said first and second direct-path speakers are first and second stereophonic speakers.

19. The sound reproduction system of claim 17, wherein said structural means for mounting said transducer is configured to permit said transducer of said dipole speaker to be positioned in said listening area independently of the positions of said direct-path speakers.

20. The sound reproduction system of claim 19, wherein said first and second direct-path speakers are forward-facing speakers arranged to face towards said listener, and said transducer of said dipole speaker is positioned rearwardly said forward-facing speakers so that said axes of said first and second sound lobes do not cross said direct paths from front-facing speakers to said listener.

21. The sound reproduction system of claim 19, wherein said first and second direct-path speakers are forward-facing speakers arranged on a first side of said listener so as to face toward said listener, and said transducer of said dipole speaker is positioned on the opposite side of said listener from said direct-path speakers so as to be remote from said direct-path speakers.

22. A method for producing an acoustical ambience effect which is perceived by a listener in a defined listening area, said method comprising the steps of:

positioning first and second direct-path speakers in said listening area so that acoustic outputs of said direct-path speakers which are generated in response to audio signals received by said first and second speakers from respective first and second channels of an audio signal source travel substantially direct paths from said speakers to said listener;

positioning a dipole speaker in said listening area at a location which is spaced apart from each of said direct-path speakers so that said acoustic outputs of said direct-path remain unblended with and distinct from an acoustic output generated by said dipole speaker in response to an audio signal received from said audio signal source, said acoustic output of said dipole speaker being characterized by first and second sound pressure lobes which extend from said dipole speaker along respective first and second axes, said first and second lobes being substantially 180 degrees out-of-phase and meeting so as to cancel each other out to form a null zone which extends form said dipole speaker substantially along a plane intermediate said first and second axes;

positioning said dipole speaker (a) so that said listener is substanially in alignment with said plane of said null zone (b) so as to prevent substantially any said acoustic output of said dipole speaker from reaching said listener via a direct path from said dipole speaker, and (c) so that first and second sound pressure lobes are reflected from walls of said defined listening area so as to arrive at said listener by way of indirect paths, at least one said indirect path being longer than either of said direct paths from said direct-path speaker to said listener so that said listener hears said distinct acoustic output of said dipole speaker arriving after a perceptible delay following the arrival of the corresponding distinct acoustic output of said direct path speakers, said perceptible delay being sufficient in length that said listener perceives said output of said dipole speaker as producing said acoustic ambience effect; and supplying an audio signal to said dipole speaker, said audio signal supplied to said dipole speaker being the difference between said audio signals of said first and second channels of said audio signal source so that said audio signal represents recorded ambience sounds which are common to said first and second channels.

* * * * *